US005794981A

United States Patent [19]

Flynn

[11] Patent Number: 5,794,981

[45] Date of Patent: Aug. 18, 1998

[54] PACKAGING SYSTEM FOR PROTECTION AGAINST THEFT BY OVERLABELING

[75] Inventor: Frank E. Flynn, Scranton, Pa.

[73] Assignee: LPS Industries Inc., Moonachie, N.J.

[21] Appl. No.: 802,056

[22] Filed: Feb. 19, 1997

[51] Int. Cl.[6] ..... B42D 15/00

[52] U.S. Cl. ..... 283/109; 283/81; 283/80; 283/107; 408/40.1; 408/41.7; 408/41.8; 408/42.1

[58] Field of Search ..... 283/109, 107, 283/81, 80; 428/40.1, 41.7, 41.8, 42.1

[56] References Cited

U.S. PATENT DOCUMENTS

| | | | |
|---|---|---|---|
| 3,931,666 | 1/1976 | Karami | 428/40.1 |
| 4,184,701 | 1/1980 | Franklin et al. | 283/109 |
| 4,933,124 | 6/1990 | Duncan | 264/22 |
| 5,174,608 | 12/1992 | Benardelli | 283/109 |
| 5,368,334 | 11/1994 | Christy et al. | 283/67 |
| 5,588,679 | 12/1996 | Slov et al. | 283/81 |
| 5,593,241 | 1/1997 | Kawaguchi | 428/41.8 |
| 5,691,022 | 11/1997 | Knauf | 428/41.8 |

*Primary Examiner*—Daniel W. Howell
*Assistant Examiner*—Adesm Bhargava
*Attorney, Agent, or Firm*—Mathews, Collins, Shepherd & Gould, P.A.

[57] ABSTRACT

In accordance with the invention, an improved packaging system for protection against the theft of goods by overlabeling comprises a layer of packaging material surrounding the goods, a label adhered to the packaging material, and a transparent film covering the label. In contrast with conventional packaging, the outer surface of the transparent film is provided with an antiadhesive coating to inhibit overlabeling. The transparent film can be smooth or textured. The advantage of texturing, as by embossing, is to reduce the surface area to which an overlabel can adhere. The antiadhesive coating is preferably a composite layer comprising a non-adhesive base coating of silicone and a layer of "tack kill" material such as an acrylic plasticizer for neutralizing a subsequently applied adhesive. The result is that a spurious label applied on the film over the original label readily disengages in the course of ordinary package handling. In addition the adhesive underside of the film can be provided with a recognizable pattern of invisible ink to permit rapid detection of tampering.

10 Claims, 1 Drawing Sheet

PACKAGING SYSTEM FOR PROTECTION AGAINST THEFT BY OVERLABELING

FIELD OF THE INVENTION

This invention relates to a package labeling system for protection against theft by overlabeling.

BACKGROUND OF THE INVENTION

Unauthorized overlabeling of packages has significantly increased in recent years, resulting in a high level of misdirection of packages and subsequent claims.

In the simplest labeling for delivery an item of merchandise is provided with a surrounding package (such as envelopes, cartons, tubes, etc. made either from rigid or flexible materials) and an address label. Such packages are often fraudulently redirected by addition of a spurious new label over the original label. A similar problem arises in retailing where a spurious price label is added over the original. A similar problem arises in retailing where a spurious price label is added over the original.

Other packaging arrangements developed in the past involve a transparent overlay which protects underlying information from being obscured or removed. See for example J. W. McConville et al., U.S. Pat. No. 4,968,063 entitled "Transparent Tamper Indicating Document Overlay" (Nov. 6, 1990) which is incorporated herein by reference.

While the transparent film reduces label substitution, there has been an increase in the theft of such packages by overlabeling. Prior to delivery, a perpetrator adds a new label over the original and sometimes a new transparent film. The new labeling materials cover the original materials and redirect the shipment from the addressee/consignee to an accomplice. Thereafter the carrier cannot prove proper delivery and must pay claim. This also applies for internal deliveries within a company or a building where there is no claim, but property loss nonetheless occurs. Accordingly there is a need for a new package labeling system which reduces theft by overlabeling.

SUMMARY OF THE INVENTION

In accordance with the invention, an improved package labeling system for protection against the theft of goods by overlabeling comprises a layer of packaging material surrounding the goods, a label to the packaging material and a transparent film covering the label. In contrast with conventional packaging, the outer surface of the transparent film is provided with antiadhesive coatings to inhibit overlabeling. In a preferred embodiment, the film is embossed to reduce the surface area to which an overlabel can adhere, and the antiadhesive coatings are composite layers comprising a non-adhesive base coating of silicone and a layer of "tack kill" material such as an acrylic plasticizer for neutralizing a subsequently applied adhesive. The result is that a spurious label applied on the film over the original label readily disengages in the course of ordinary package handling (the level of disengagement can be controlled). In addition the adhesive underside of the film can be provided with a recognizable pattern of invisible ink to permit rapid detection of tampering.

BRIEF DESCRIPTION OF THE DRAWINGS

The advantages, nature and additional features of the invention will appear more fully upon consideration of the illustrative embodiments described in the accompanying drawings.

In the drawings.

It is to be understood that the drawings are for illustrating the concepts of the invention and are not to scale.

DETAILED DESCRIPTION

Figure 1:
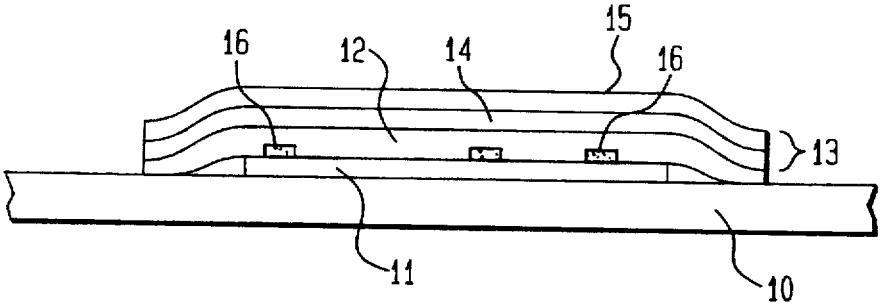
FIG. 1 is a schematic cross section of a packaging arrangement in accordance with the invention.

Referring to the drawings, FIG. 1 is a schematic cross section of a package labeling system for protection against theft by overlabeling. The labeling system comprises a layer of packaging material 10 for enclosing an article of commerce (not shown), a label 11, such as an address label or a price label, adhered to the packaging material, and a layer of transparent film 12 adhered over the label. In contrast with conventional packaging, the outer surface of the transparent film is provided with an antiadhesive coating 13 to inhibit overlabeling.

The package material 10 is typically kraft paper or corrugated. The label 11 is typically a paper label provided with an aggressive adhesive such as water-emulsion acrylic to preclude label switching, and the transparent film is typically a strong polymer film such as polypropylene provided with an adhesive such as clear water-emulsion acrylic on the side contacting the label 11 (Adhesive layers not shown).

The antiadhesive coating 13 on the outer surface of film 12 is typically a silicone cured to form a release coating. The formation of silicone release coatings on polymer films is described in detail in G. L. Duncan, U.S. Pat. No. 4,933,124 entitled "Process of Applying A Silicone Release Coating To An Oriented Polymer Film" (Jun. 12, 1990) which is incorporated herein by reference. The preferred coating 13 is a composite layer including not only a base layer 14 of silicone but also an additional layer 15 of "tack kill" material to neutralize the adhesive properties of a subsequently applied overlabel. Preferred "tack-kill" materials are acrylic plasticizers such as Union Carbide VINS and Eastman Kodak VMCH.

Figure 2:
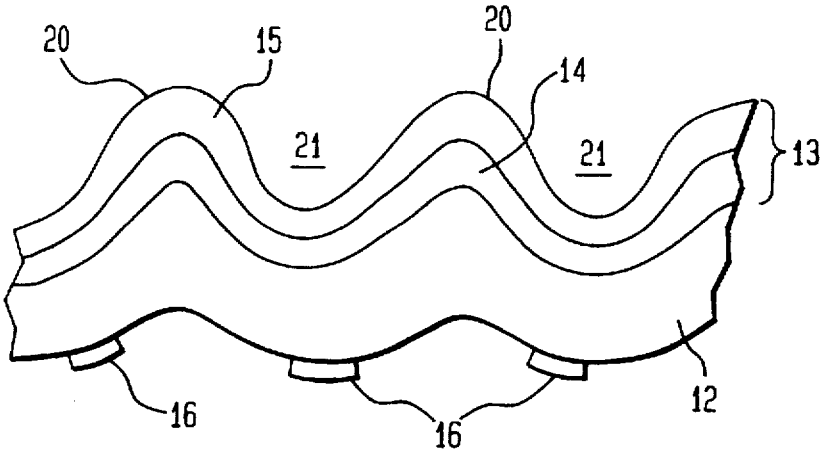
FIG. 2 is an enlarged view of film useful in the packaging arrangement of FIG. 1.

As shown in the enlarged view of FIG. 2, transparent film 12 is advantageously textured, as by embossing, to define an array of outwardly projecting regions 20 separated by recessed regions 21. The outer surface of film 12 (and particularly the projecting regions 20) is provided with antiadhesive coating 14, 15. The advantage of this texture is that the surface of film 12 to which an overlabel can be applied is effectively reduced to the projecting regions 20 making adhesion of the overlabel even more difficult. Moreover the recessed regions 21 provide passageways for air to enter under an overlaid label and blow it off.

The formation of textured surfaces in polymer films by embossing is described in F. Bustin, U.S. Pat. No. 3,857,144 entitled "Method of Embossing Limp Plastic Sheet Material" Dec. 31, 1974) which is incorporated herein by reference.

Yet a further measure to guard against overlabeling is to print or stamp a recognizable pattern 16 in "invisible" ink underlying the upper surface of film 12. The pattern can be formed on the packaging material, the label or the underside of film 12. Such inks can be selectively visualized under ultraviolet or infra-red lamps. See O. D. Christy et al., U.S. Pat. No. 5,368,334 entitled "Variable Data Clear Marking Image" (Nov. 29, 1994), which is incorporated herein by reference.

Figure 3:
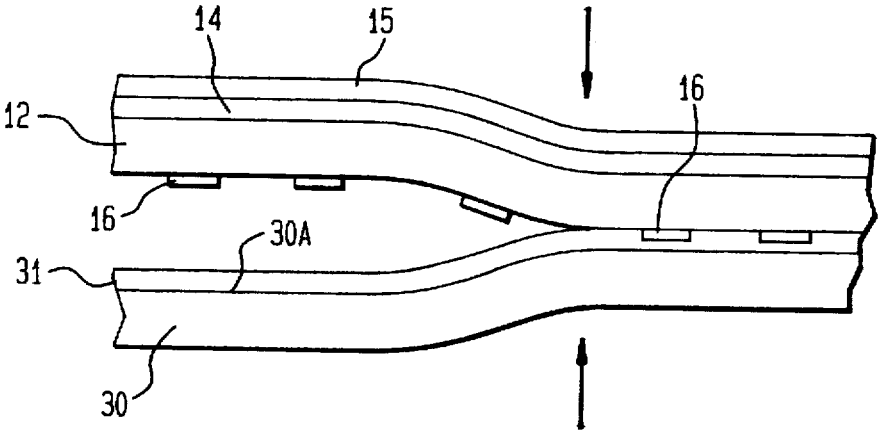
FIG. 3 illustrates a convenient way of providing the film for use in the arrangement of FIG. 1.

The invention can be more clearly understood by consideration of the specific example of providing a suitable film described in relation to FIG. 3.

EXAMPLE

As illustrated in FIG. 3, a 3–4 mil polypropylene film 12 is optimally printed on the underside with an invisible ink pattern 15 using Invis-graphics #318 invisible ink. The upper side of the film is then coated with a non-adhesive coating 14 of Rad-cure #500 silicone coating (2 lb/ream coating weight). The silicone coating is cured by a 2 s passage beneath an ultraviolet light (A-Teck Mfg. Co. 400 watt UV bulb). The film is then embossed to a linen pattern texture (not shown in FIG. 3), and the embossed surface is coated with a tack-kill coating 14 of Rad-Cure #700 TC (4–5 lbs/ream) which is also subjected to a 2 s ultraviolet light cure.

For convenience in handling, after the film is processed, it is temporarily adhered by the underside to a silicone-coated paper 30. Specifically, silicone coated paper in the form of James River #40 - SRO - 6 is first coated on the silicone surface 30A with an adhesive coating 31 such as national starch #1540. The underside of the film 12 is pressed against the adhesive coating 31, and the resulting laminate can be cut and wound into tape rolls.

In use, when the film 12 is separated from the paper 30, the adhesive coating 31 transfers to the film. The film is then adhered over a package label as shown in FIG. 1 where it provides a surface that is very difficult to overlabel. A spurious label applied on the film over the original label is usually removed in the normal course of package handling, resulting in exposure of the original label and correct delivery. If desired the package can be subjected to special treatment, such as directed air jets, to further ensure the removal of spurious overlabels. In addition, upon exposure to UV light, the film presents a recognizable pattern in invisible ink.

It is to be understood that the above-described embodiments are illustrative of only a few of the many possible specific embodiments which can represent applications of the invention. Numerous and varied other arrangements can be made by those skilled in the art without departing from the spirit and scope of the invention.

What is claimed is:

1. A labeled package comprising;

a package, a label adhered to said package; and covering said label, an adhesive transparent film comprising a film of transparent material having two major surfaces, a coating of adhesive material on one major surface for adhering to said label and a coating of antiadhesive material on the other major surface for resisting theft by overlabeling.

2. The labeled package of claim 1 wherein said transparent film is textured to reduce the area of contact for a subsequently applied label.

3. The labeling package of claim 1 wherein said coating of antiadhesive material comprises a composite coating comprising a non-adhesive coating of silicone and a coating of tack killing material for neutralizing the adhesive properties of a subsequently applied adhesive.

4. The labeled package of claim 3 wherein said tack-killing material comprises acrylic plasticizer.

5. The labeled package of claim 1 wherein a pattern of invisible ink is formed underlying the outer surface of said transparent film.

6. An adhesive transparent film for protecting a labeled package from theft by overlabeling comprising:

an embossed film of transparent polymer, said film having two major surfaces, a coating of adhesive material on one major surface for adhering to said labeled package, and an antiadhesive coating on the other major surface for resisting adherence of a subsequently applied overlabel.

7. A film according to claim 6 further comprising a pattern of invisible ink underlying the antiadhesive coated surface.

8. A film according to claim 6 wherein said coating of antiadhesive material comprises a composite coating of silicone and acrylic plasticizer.

9. A film according to claim 6 wherein said transparent polymer comprises polypropylene.

10. A film according to claim 6 further comprising a layer of silicone-coated paper laminated to the adhesive coated surface for ease of handling.

* * * * *